United States Patent [19]

Van Jepmond et al.

[11] 4,102,532

[45] Jul. 25, 1978

[54] GAME METHOD AND APPARATUS FOR SENSING THE POSITION OF AN OBJECT WITH RESPECT TO ITS RECEPTACLE

[75] Inventors: Howard K. Van Jepmond, Menlo Park; Ronald E. Milner, Grass Valley, both of Calif.

[73] Assignee: Atari, Inc., Sunnyvale, Calif.

[21] Appl. No.: 738,669

[22] Filed: Nov. 4, 1976

[51] Int. Cl.[2] ..... A63B 69/00; G08B 21/00

[52] U.S. Cl. ..... 273/1 E; 273/101.1; 273/DIG. 28; 340/572

[58] Field of Search ..... 272/1 E, 101.1, 101.2, 272/DIG. 28, 85 R, 52 R, 54 E, 136 A, 137 A; 343/225-227; 340/280, 323 R, 324 A, 324 AD, 324 M, 337, 323; 240/6.41; 35/9 R, 9 B, 25, 9; 273/1 E, 85, 52, 54, 101.1, 101.2, 136, 137, DIG. 28

[56] References Cited

U.S. PATENT DOCUMENTS

| | | | |
|---|---|---|---|
| 2,710,754 | 6/1955 | Varney | 273/101.1 |
| 2,942,882 | 6/1960 | Kuenstler et al. | 273/1 E |
| 3,271,032 | 9/1966 | Rabinowitz et al. | 273/101.1 |
| 3,405,457 | 10/1968 | Bitzer | 35/9 R |
| 3,509,350 | 4/1970 | Gundrum | 340/324 R X |
| 3,530,451 | 9/1970 | Devine | 340/280 X |
| 3,549,147 | 12/1970 | Katter | 273/101.1 |
| 3,599,221 | 8/1971 | Baer | 35/9 R X |
| 3,728,480 | 4/1973 | Baer | 273/1 E UX |
| 3,870,305 | 3/1975 | Harclerode | 273/101.1 |
| 3,874,669 | 4/1975 | Ariano et al. | 273/DIG. 28 |
| 3,877,157 | 4/1975 | Ashford et al. | 273/101.1 |
| 3,898,747 | 8/1975 | Marshall | 35/25 |
| 3,960,380 | 6/1976 | Yokoi | 273/101.1 |

FOREIGN PATENT DOCUMENTS

| | | | |
|---|---|---|---|
| 366,228 | 12/1962 | Switzerland | 273/52 |

OTHER PUBLICATIONS

*Electronics*; "Remote TV Control"; May 13, 1960; p. 79.

*Primary Examiner*—Vance Y. Hum
*Attorney, Agent, or Firm*—Flehr, Hohbach, Test, Albritton & Herbert

[57] ABSTRACT

An electrical circuit for sensing the position of an object with respect to its receptacle. Within the receptacle is mounted a light emitting diode (LED) that generates coded pulses of light. The pulses are sensed by a photodetector mounted on the object. The circuit further includes a clock, gates and a D-flip-flop that together determine whether the photodetector is sensing the coded pulses from the light emitting diode. The light emitting diode and the photodetector are positioned such that the photodetector only senses the coded pulses when the object is located within the receptacle.

8 Claims, 2 Drawing Figures

GAME METHOD AND APPARATUS FOR SENSING THE POSITION OF AN OBJECT WITH RESPECT TO ITS RECEPTACLE

BACKGROUND OF THE INVENTION

This invention relates generally to video action games and more particularly to the positioning of equipment used in the play of such games.

Video games are interactive games played on television sets or television monitors. The games generally involve the motion of images and the manipulation of symbols that appear on TV screens. The players either match their skills against each other or against the software programs incorporated in the electronic circuits in the games. Points are scored according to the relative skill used in moving the symbols.

One common video game is the shooting game wherein the players simulate shooting targets that are displayed and moved on a TV screen. The players use hand-held guns that extend from the game cabinets. Usually in these games the gun contains an optical detector circuit in its muzzle and operates on the light radiated from the TV screen. The output signal from the optical detector is passed by a control cable to the electronic control circuitry within the game cabinet. When the trigger of the gun is squeezed, the electronic control circuitry measures the player's aim point on the TV screen. More specifically, the control circuitry checks for the coincidence of the optical detector's output and the occurance of the video signal producing the image aimed at on the TV screen. The control circuitry thus determines whether or not the player has hit the image displayed on the screen.

Within the field of shooting games there are some games that challenge the skill of the player with one of America's most traditional contests — the fast draw shootout. In these games the players try to outdraw a gun fighter that is suddenly displayed on the TV screen. In playing the game each player pulls a replica of a pistol from a holster mounted on the game cabinet and attempts to shoot the image of an outlaw. The electrical control circuitry determines who drew first, who fired first, and who hit whom.

A continuing problem in developing the fast draw type game has been the inability to prevent the players from defeating the game by prematurely drawing the gun and waiting with the gun poised for the image to appear. In the past mechanical relays, proximity switches and microswitches have been used to signal the withdrawal of the gun from the holster. When these switches have been used, the games are easily defeated by players who depress the mechanical switches with sticks or metal rods. The player can then simultaneously release the holster switch and pull the trigger of the gun.

Another problem occurring with the fast draw type games has been in designing a holster switch that can stand up to the physical wear and tear common to these games. Besides the cyclical drawing of the gun and the wear from players trying to defeat the switch, there is the physical abuse that the public gives these machines.

OBJECTS AND SUMMARY OF THE INVENTION

It is the primary object of the present invention to provide a novel method and apparatus that overcomes the limitations and disadvantages of the prior art.

A further object of the present invention is to prevent players of a fast draw type game from prematurely drawing the gun from its holster and thereby defeating the purpose of the game.

An additional object of the present invention is to provide precise positioning information about the gun during the play of a shooting game so that the game can be properly sequenced.

The foregoing and other objects are achieved by an electrical circuit that includes an optical detector located in the muzzle of the gun and a light emitting diode (LED) positioned in the holster. The light emitting diode is pulsed in a timed sequence so that the light radiated from it can be distinguished from the TV screen and ambient illumination. When the gun is placed in the holster, the optical detector in the gun is aligned so that the gun receives the pulses of light from the light emitting diode and the electrical circuit generates a gun-in-holster signal.

When the gun is removed from the holster, the pulses of light are not received by the optical detector and the electrical circuit generates a gun-not-in-holster signal.

In addition, the electrical circuit pulses the light emitting diode with a high output during a very small duty cycle so that a short, high amplitude pulse of light can be sensed with a fast, insensitive photodetector.

Additional objects and features of the invention will be evident from the following description in which the preferred embodiment has been set forth in detail in conjunction with the accompanying drawings.

DESCRIPTION OF THE PREFERRED EMBODIMENT

Physical Description of a Fast Draw Type Game and its Play

Figure 1:
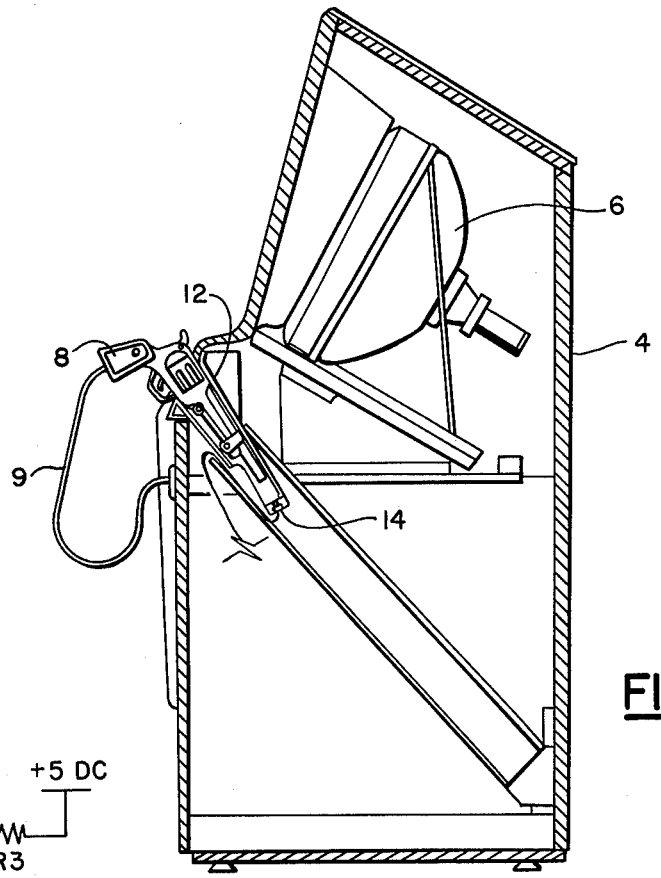
FIG. 1 is a side elevational view of a game cabinet for a fast draw type video game according to the present invention.

Referring to FIG. 1, the fast draw type game in the preferred embodiment is a one-player, video action game packaged in its own cabinet 4. The cabinet is upright and rests directly on the floor. Each player stands in front of the cabinet while playing the game. A conventional black and white TV monitor 6 is mounted to face toward the front of the cabinet. During the play of the game the player observes the images and symbols as they flash on the screen of the monitor. Located on the front panel of the cabinet 4 near the bottom is a speaker (not shown). During the play of the game the speaker produces the sounds of footsteps and gunfire.

The player-operated controls (not shown) are located just below the TV screen on the front panel of the cabinet. These controls include various switches and a pistol 8 that is connected to the cabinet 4 by a cable 9. The pistol rests in a holster-like receptacle 12 mounted on the front panel of the cabinet. During the play of the game the pistol is drawn and fired at the TV screen by the player.

The game is basically a test of skill wherein the player tries to shoot the outlaw before the outlaw shoots him. The outlaw is a human shaped image that suddenly appears at a random location on the TV screen 6 and starts running toward the center of the screen. After a run of variable length, the outlaw stops, turns toward the player, sinks into a crouching position, and fires at the player. The speaker (not shown) produces the sounds of footsteps while the outlaw is running and the sounds of gunfire.

The game is designed so that the player must leave the pistol 8 in the holster 12 until the image of the outlaw appears on the screen 6. If the player prematurely draws the gun, a legend "Cowards Shoot First" is flashed on the screen and play stops. When the outlaw image appears, the player draws the pistol from the holster and aims it at the outlaw. When the player pulls the trigger, a white impact spot appears on the screen corresponding to the aiming point of the pistol. Whenever the impact spot covers or touches any part of the image of the outlaw, the outlaw falls and then disappears. One point is then scored for the player. If, however, the outlaw is able to shoot before the player can hit him, a point is scored for the outlaw. After the outlaw shoots or is hit, a legend is flashed on the screen directing the player to return pistol to the holster. The game is designed so that the pistol must be in the holster before a new outlaw image will appear on the screen.

Pistol-in-holster Detection Circuitry

As described above, the player must return the pistol 8 to the holster 12 at certain times during the game in order for play to continue. The positioning of the pistol in the holster is detected through the use of a light emitting diode (LED) 14 that is mounted inside of the holster 12. The LED is aligned so that when the pistol is seated in the holster the illumination shines directly into the barrel 16 of the pistol. The pistol has a very narrow highly collimated optical field of view that is achieved by using conventional lenses.

Figure 2:
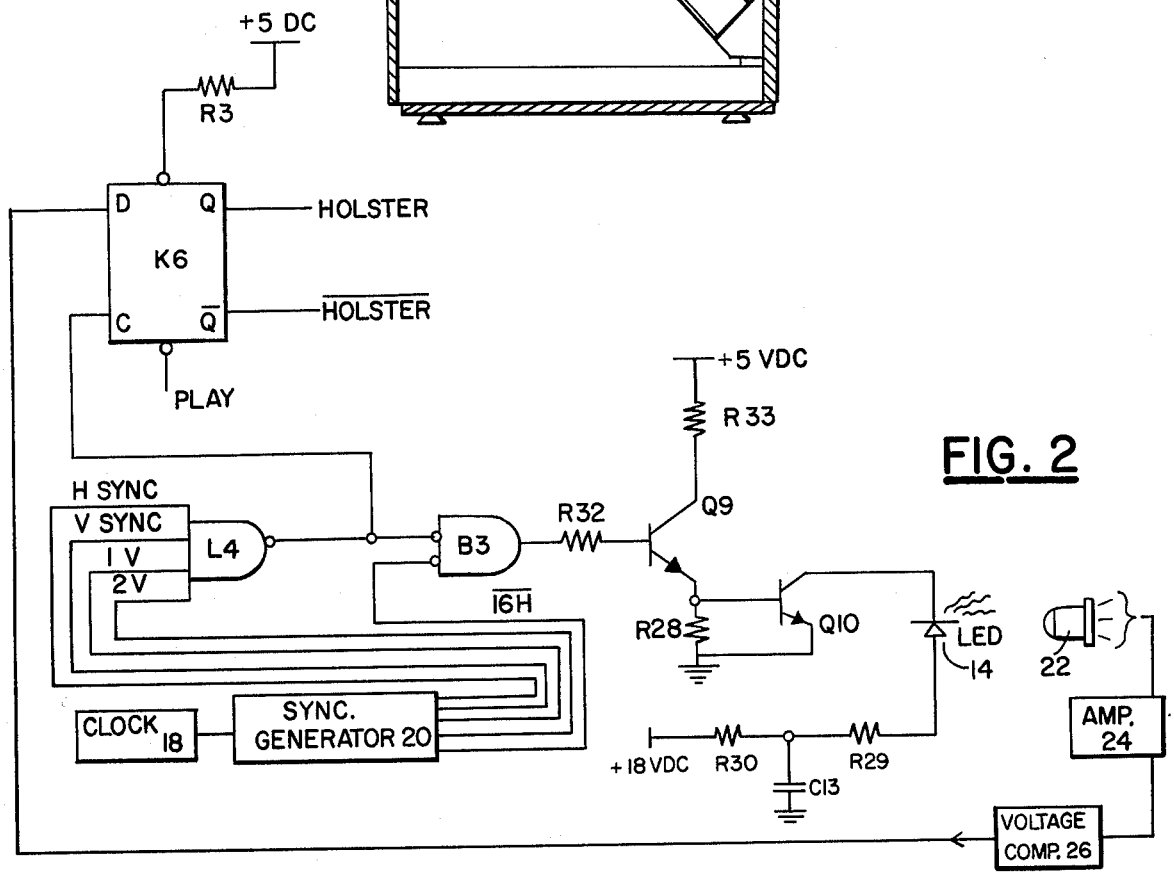
FIG. 2 is a schematic diagram of an electrical circuit within the game cabinet of FIG. 1 according to the present invention.

Referring to FIG. 2, the LED 14 is only pulsed during the vertical blanking of the composite video signal that synchronizes the TV monitor. This is done so that the output signal obtained from the LED is not confused with the signals caused by the light coming from the scan lines on the TV screen 6. To pulse the LED 14 in this manner a fourteen megahertz crystal oscillator or clock 18 is used. The output of the clock is passed to a conventional synchronization generator 20. The synchronization generator includes a conventional frequency-divide-down circuit with digital counters. In the preferred embodiment the synchronization generator used type 93000 IC's and flip-flops.

As illustrated in FIG. 2, the synchronization generator has five outputs identified as H-sync, V-sync, 1V, 2V and $\overline{16H}$. Within the sync generator the 16H pulse is divided down six times by two from the input frequency of fourteen megahertz. The 1V pulse is divided down eleven times by two within the sync generator and the 2V pulse is likewise divided down twelve times by two. The H-sync is a horizontal synchronization timing pulse that occurs at the end of the horizontal synchronization count. The time interval between successive H pulses is approximately sixty-four microseconds. The V-sync pulse is a vertical synchronization timing pulse and the interval between these sync pulses is approximately 16.7 milliseconds. The V-sync signal has a width equal to four horizontal lines on the TV monitor 6.

The four signals H-sync, V-sync, 1V and 2V from the sync generator 20 are applied to a NOR gate L4. The output of gate L4 is a five microsecond pulse that is complemented and applied to an OR gate B3. The signal $\overline{16H}$ from the sync generator 20 is complemented by the OR gate B3. The output of gate B3 is a 2.5 microsecond pulse that drives transistor Q9, which in turn drives transistor Q10. Transistors Q9 and Q10 are connected as a Darlington amplifier to produce current for pulsing the LED 14. Transistor Q9 operates in the manner of a switch that turns transistor Q10 on and off. Transistor Q10 is a power transistor that is chosen for supplying high current.

The light emitting diode (LED) 14 is a conventional LED that is driven by eighteen volts DC. The duration of the LED flash time is equal to that of one horizontal synchronization period during horizontal line in V-synchronization. This is a 0.015% duty cycle. With this low duty cycle it has been observed that the LED can withstand a peak current of six amperes and produces an intense pulse of light.

If the pistol 8, FIG. 1 is resting in the holster 12, the pulses of light from the LED 14 are received by a conventional photo diode 22, located within the barrel 16 of the pistol. The muzzle of the pistol contains a narrow-beam-width optical lens that focuses incident light onto the photo detector 22. The output of the photo detector is an analog signal proportional to the intensity of the light incident on the detector. This analog signal is amplified by a small preamplifier 24 and is passed to a voltage comparator 26. The voltage comparator acts like a discriminator to separate out signals caused by ambient, background light. If the intensity of light received by the photo detector 22 exceeds a preset minimum threshold value, the voltage comparator 26 produces a signal that is applied to the D input of a D-type flip-flop, K6. The five microsecond wide pulse from the output of gate L4 is also connected to the clock input C of the flip-flop K6. With this clocking signal, the flip-flop interrogates the output from the voltage comparator 26 with a two microsecond delay in order to give a margin against the other delays in the optical detection circuit of the pistol. The D flip-flop K6 is enabled by a PLAY signal indicating that the game is running. If a coin has not been inserted into the game, a PLAY signal is not present at the flip-flop and the flip-flop does not register the position of the gun with respect to the holster.

In operation, the LED 14 is pulsed by the sync generator 20 to produce coded pulses of illumination that can be received by the optical detector 22. The pulse that triggers the LED also clocks the D type flip-flop K6. The pulse is timed so that it does not occur while the TV screen 6 is being illuminated. The light sensed by the photo diode 22 is converted into an electrical signal that is amplified and discriminated. The discriminator separates out the ambient illumination.

When the game is running, a PLAY signal enables the flip-flop K6. When the clocking signal from the NOR gate L6 is received by the D-type flip-flop K6, the flip-flop interrogates the output of the voltage comparator 26. If there is an output during this interrogation period, the flip-flop K6 generates a pulse HOLSTER from the Q output of the flip-flop. A HOLSTER output pulse indicates that the gun is in the holster. If there is no output from the voltage comparator 26 when the flip-flop K6 is clocked by the NOR gate L6, the flip-flop K6 produces a pulse $\overline{\text{HOLSTER}}$ from the $\overline{Q}$ output. A $\overline{\text{HOLSTER}}$ output pulse indicates that the gun is not in the holster.

Thus, the circuit is only sensitive to the coded light emitted by the LED. The players are prevented from defeating the game by prematurely drawing the gun since the gun must receive the LED pulses before the game will continue. In addition, the use of an LED and the sensing circuit of the present invention eliminates the requirement for a mechanical holster switch.

Although the best mode contemplated for carrying out the present invention has been herein shown and described, it will be apparent that modification and variation may be made without departing from what is regarded to be the subject matter of the invention.

What is claimed is:

1. Video game apparatus for determining the position of a simulated weapon employed in the play of an amusement game with respect to a receptacle for said simulated weapon, comprising:

(a) video display means;

(b) a movable simulated weapon employed in the play of a video amusement game;

(c) a receptacle for said simulated weapon operatively connected to the video game;

(d) control means connected to a light source for propagating coded light, said light source being mounted on one of either the simulated weapon or the receptacle;

(e) optical detecting means for receiving the coded light propagated from the light source, said detecting means being mounted on one of either the simulated weapon or the receptacle but not coincident with the light source;

(f) circuit means connected between the light source and the optical detecting means for determining coincidence between the coded light propagated from the light source and the light received by the optical detecting means, said light source and said optical detecting means being positioned such that the position of the simulated weapon with respect to its receptacle is determinable from the receipt of the coded light as indicated by said coincidence; and (g) means responsive to the circuit means for enabling the video display means.

2. The apparatus of claim 1 wherein said control means actuates the light source in a manner such that a sequenced pattern of pulses of a light is propagated therefrom, and wherein the circuit means includes gating means actuated by the control means for measuring the coincidence between the coded light that is transmitted and the light that is received by the apparatus.

3. Video game apparatus for determining whether coded light propagated in connection with a video amusement game is received by the amusement game, comprising:

(a) a simulated weapon;

(b) a weapon support;

(c) a video display;

(d) a light source for generating and propagating coded light;

(e) optical detecting means for receiving the coded light, said detecting means converts the coded light into corresponding electrical signals;

(f) clocking means connected to the light source for coding the light propagated therefrom, said clocking means being adapted for synchronizing a raster scan video display of a video game;

(g) gating means connected to the clocking means and the optical detecting means for determining whether the coded light propagated from the light source is received by the detecting means, said gating means includes coincidence determining means actuated by the clocking means for measuring the coincidence between the coded light that is transmitted and the light that is received by the apparatus; and (h) means responsive to the coincidence determining means to enable the video display.

4. The apparatus of claim 3 further including a Darlington amplifier for generating electrical pulses connected to the light source and wherein said light source includes a light-emitting diode (LED) connected so that the LED is pulsed to high output at a small duty cycle and thereby provides a short, high amplitude pulse.

5. A method for determining the position of a simulated weapon employed in the play of a video amusement game with respect to a receptacle for said simulated weapon, comprising the steps of:

(a) positioning a light source on one of either the simulated weapon or the receptacle each of which is employed in the play of the video amusement game;

(b) positioning an optical detecting means on one of either the simulated weapon or the receptacle but not coincident with the light source;

(c) coding the light propagated from the light source;

(d) determining whether the coded light propagated from the light source is received by the optical detecing means;

(e) aligning the light source with respect to the optical detecting means such that the coded light is received by the optical detector when the simulated weapon is received in its receptacle; and (f) enabling the video amusement game consequent to detection of the coded light.

6. The method of claim 5 wherein the step of determining whether the coded light propagated from the light source is received by the optical detecting means includes the step of measuring the coincidence between the coded light that is propagated from the light source and the light sensed by the optical detector.

7. The method of claim 5 wherein the step of coding the light propagated from the light source includes the step of pulsing a light emitting diode light source to high output at a small duty cycle by connecting a Darlington amplifier to the light source.

8. Apparatus for determining the position of a simulated weapon employed in the play of an amusement game with respect to a receptacle for said simulated weapon, said game being played on a TV monitor, comprising:

(a) a movable simulated weapon employed in the play of a video amusement game;

(b) a receptacle for said simulated weapon operatively connected to the game;

(c) control means connected to a light source for propagating coded light, said light source being mounted on one of either the simulated weapon or the receptacle, said control means including means permitting coded light propagation during monitor blanking so that the light source propagates coded light during time periods when the TV monitor is being blanked;

(d) optical detecting means for receiving the coded light propagated from the light source, said detecting means being mounted on one of either the simulated weapon or the receptacle but not coincident with the light source;

(e) circuit means connected between the light source and the optical detecting means for determining whether the coded light propagated from the light source is received by the optical detecting means, said light source and said optical detecting means being positioned such that the position of the simulated weapon with respect to its receptacle is determinable from the receipt of the coded light; and (f) means responsive to said circuit means for enabling the TV monitor.

* * * * *